US006854662B2

(12) United States Patent
Chen

(10) Patent No.: US 6,854,662 B2
(45) Date of Patent: Feb. 15, 2005

(54) NEBULIZER ASSEMBLY

(75) Inventor: Wen-Pin Chen, P.O. Box No. 6-57, Chung-Ho, Taipei (TW)

(73) Assignees: Kai Chih Industrial Co., Ltd., HsinTien (TW); Wen-Pin Chen, Taipei (TW)

( * ) Notice: Subject to any disclaimer, the term of this patent is extended or adjusted under 35 U.S.C. 154(b) by 21 days.

(21) Appl. No.: 10/374,995

(22) Filed: Feb. 28, 2003

(65) Prior Publication Data

US 2003/0234298 A1 Dec. 25, 2003

(30) Foreign Application Priority Data

Jun. 25, 2002 (TW) ..... 91209561 U

(51) Int. Cl.[7] ..... B05B 3/14

(52) U.S. Cl. ..... 239/102.2; 239/102.1; 239/4; 239/86; 239/596; 239/145

(58) Field of Search ..... 239/102.2, 102.1, 239/338, 86, 326, 145, 596, 548, 566, 4

(56) References Cited

U.S. PATENT DOCUMENTS

| | | | | | |
|---|---|---|---|---|---|
| 4,533,082 | A | * | 8/1985 | Maehara et al. | 239/102.2 |
| 4,605,167 | A | * | 8/1986 | Maehara | 239/102.2 |
| 5,152,456 | A | * | 10/1992 | Ross et al. | 239/102.2 |
| 5,299,739 | A | * | 4/1994 | Takahashi et al. | 239/102.2 |
| 5,823,428 | A | * | 10/1998 | Humberstone et al. | 239/4 |
| 6,722,582 | B2 | * | 4/2004 | Hess et al. | 239/102.2 |

* cited by examiner

*Primary Examiner*—Patrick Brinson
(74) *Attorney, Agent, or Firm*—Troxell Law Office PLLC

(57) ABSTRACT

A nebulizer assembly, and more particularly, for nebulizing liquids into aerosols, includes an oscillation driver connected with an aerosol excitation device at one end thereof, a liquid delivery device adjacently disposed to the aerosol excitation device for supplying an impingement baffle provided in the aerosol excitation device with micro liquid bodies having tension liquid membranes, so that energy is completely acted upon the micro liquid membranes for excitation into aerosol particles, thereby achieving aimed excitation without causing unnecessary loads.

7 Claims, 4 Drawing Sheets

NEBULIZER ASSEMBLY

BACKGROUND OF THE INVENTION (a) Field of the Invention

The invention relates to a nebulizer assembly, and more particularly, to a nebulizer in which an oscillator driver is provided with an aerosol excitation device at the power output terminal thereof, and the aerosol excitation device is adjacently disposed to a liquid delivery device for supplying an impingement baffle of the aerosol excitation device with micro liquid bodies having formed tension liquid membranes, thereby acting energy completely onto the micro liquid membranes for nebulizing aerosol particles and further achieving aimed nebulization as well as avoiding any unnecessary loading.

(b) Description of the Prior Art

A nebulizer assembly particularly applied in aerosol nebulizers comprises an oscillator driver for loading an aerosol excitation device provided on an acting plane, and a liquid delivery device adjacently disposed to the aerosol excitation device for supplying an impingement baffle of the excitation device with liquid membranes for further micro loading and impingement. Therefore the energy of the excitation device is totally acted onto the liquid bodies in micro units and maximizes the efficiency thereof.

In the early days, prior arts for producing aerosols include forming aerosols from steam by heating in order to provide humidifying or medical auxiliary equipment applications. However, energy required for forming steam by heating is rather significant, and heating is often unfavorable for controlling medical properties of medical materials because temperature changes are liable to bring chemical reactions. Later, the prior art is improved by ultrasonic actions of mechanical oscillation to have aerosols of liquid particles break away from liquids or medical solutes by oscillation.

In conventional ultrasonic oscillation, the oscillation energy thereof comes into contact with the surface of a liquid and breaks micro liquid particles formed by excitation away from the liquid. A fan then blows and forwards the aerosol of micro particles to the user's terminal. Nevertheless, such method of ultrasonic employs the oscillator for loading the impingement baffle for further direct contact with the liquid surface, and hence the oscillator is necessarily large in size and power in order to conduct energy within the liquid for stimulating the liquid surface. Also, the impingement baffle is in direct contact within the liquid, and thus the produced oscillation energy is forced to accept the unavoidable contact loss of the liquid. As a result, a large power that relatively consumes significant energy is required. Furthermore, due to various amounts and volumes of the remaining liquid, the waves of oscillation produce aerosol particles having different sizes that even need blowing by fans, and the oscillator in a no-load status is prone to breakage as well as damages when not cooled. In the aforesaid method, between the impingement baffle and the reservoir is a horizontal configuration to have the impingement baffle operate according to the water level. However, particles formed by such method are likely to differ in size for that the water level may change easily. An impingement baffle directly attached to one side of a reservoir and a diversion method using a delivery tube have then become available recently, such that a liquid is delivered to an acting plane of internal pressure of the impingement baffle using gravity, thereby providing aerosolized medical materials from medical solutes. Yet, the medical solutes flaw the above structure by leaking and overflowing through the impingement orifices of the impingement baffle for that the medical solutes are directly flowed and spread to the acting plane of internal pressure of the impingement baffle. What is more is that in the aforesaid structure, the oscillation energy of the impingement baffle suffers significant energy losses by accepting the reverse absorption of the reserved liquid as a whole. Examples of such are portable medical nebulizers that are sold by Japan and consume substantial amounts of power.

The prior ultrasonic applications have the shortcomings below:

1. large power consumption; 5 to 28 W of power supply is required for obtaining practical aerosolization;
2. complicated in structure and bulky in size; hence inadaptable for carrying along with;
3. short impingement distance; in order to flow away rapidly, additional fans are needed for driving the aerosols produced, thus adding the size, weight as well as power consumption and noise of the mechanism;
4. low reliability; the ceramic piece therein is easily damaged by high temperatures in a no-load status (no liquid loaded thereupon), bringing consequent breakage of the ceramic, and peeling off and forming blisters of the membranes at the electroplated or silver-plated conducting terminals, or the ceramic may even lose the functions thereof when the temperature rises over the Curie temperature (point of zero charge, PTZ), which is approximately 200° C.;
5. incapable of effectively controlling the diameters of the aerosolized particles; particles with diameters between 0.5 to 5 um account for only 70% of the aerosolized particles when operating at frequencies as high as 2 to 3 MHz—it is unlikely to unify the sizes of the aersolized particles;
6. inferior efficiency of the drive circuit; the efficiency as whole only reaches n<35, wherein the conventional LC resonance circuit thereof is incapable of adjusting the operating frequency and output power thereof; in addition, full power oscillation is performed when the ceramic therein is in a light-load or no-load status in the lack of load feedback control, thus causing damages by high temperatures that cannot be totally avoided even if a temperature switch is used for protection;
7. direct contact of the ceramic piece therein with the liquid in operation in a conventional nebulizer; however, the voltage of the electrodes of the ceramic piece is above $80V_{AC}$ when being operated, electrolysis and gases such as hydrogen peroxide are easily produced and then spoil the ingredient of the liquid; also, the complexity, weight and volume of the mechanism are increased for making an additional insulation;
8. the structure of common nebuizers being brittle and failing to pass the falling test of the UL Specifications; the reason behind this is that large ceramic pieces having sizes above 25 mm are preferably used for obtaining practical amounts of aerosolization; and
9. power above 5 W; certain medical properties may be changed.

SUMMARY OF THE INVENTION

Therefore, an object of the invention is to provide a nebulizer assembly capable of controlling the diameters of the aerosolized particles produced within 2 um±0.5 um. Moreover, at an adjacent plane of the impingement baffle thereof is provided with a liquid delivery device for drawing liquids from all directions and further forming liquid membranes at the acting plane of internal pressure relative to the impingement baffle. The energy generated from the actions of the impingement baffle is thoroughly employed for energy conversion of micro liquid bodies in micro volume units, so that the energy thereof amplifies for a full-load effect and relatively reduces unnecessary loads, thereby achieving high efficiency and significantly lowering resources required. Furthermore, the injection distance of the aerosols produced virtually reaches more than 15 cm, and the power required for producing such aerosols satisfactory for medical purposes and any kind of humidification is merely between 0.5 W to 0.8 W. It is of course then, the amount of aerosols produced may be varied by choosing different sizes of the mechanism and magnitudes of the kinetic powers.

In addition, the drive circuit according to the invention is connected with LC resonators using a PWM, and hence >82% efficiency may be gained at very low voltages of approximately 2V direct current. Also, the circuit may be adjusted for choosing the different output powers and operating oscillation frequencies thereof. In accordance with the invention, 2 No. 3 batteries having 3V voltage are able to continuously operate for more than 120 minutes, thus greatly breaking through the engineering bottleneck of conventional portable nebulizers. Prior similar products that use three high-voltage 3 A lithium batteries may only operate for 15 minutes due to the large power consumption thereof. Besides that, aerosol particles produced by these prior similar products occur in various sizes as well.

The drive circuit according to the invention may be further provided with an automatic power feedback to automatically adjust the magnitude of the output power thereof for saving power consumption, depending on the weight of loads. Therefore, through the low power requirement, simple structure and high efficiency provided by the invention, the invention offers easiness and convenience for portage such as handholding and placing in one's pocket. The easy replacement of the batteries thereof further facilitates the invention to be applied in all kinds of humidification and medical aerosolization of medical materials for inhalation therapies, water-constant controls for biological planting, excitation apparatus that excite and change oscillation of particles in alcoholic drinks to change the molecular structures and element displacements thereof for acquiring better tastes, or even beauty equipment for removing impurities on the skin surface.

In the nebulizer assembly in accordance with the invention, an oscillation driver is combined with an excitation device at the action output terminal thereof. The excitation device comprises an impingement baffle provided with a plurality of micro impingement orifices at the breadth thereof, and a liquid delivery device that draws a liquid in micro liquid membranes for supplying the impingement baffle with kinetic energy for further full-load excitation of micro loads, thereby achieving the purposes of obtaining high efficiency, simplifying mechanism structure and lowering power consumption.

The other object of the invention is to utilize the impingement orifices that may also be provided as cones for producing high speed and for further lengthening the injection distance of the aerosols generated.

The third object of the invention is to increase the steeliness of the impingement baffle for regulating the kinetic energy at the breadth thereof by providing a reinforcement side wing at one side of the impingement baffle of the nebulizer assembly.

The fourth object of the invention is to increase the steeliness of the impingement baffle by providing a flange rib at the breadth of the impingement baffle.

The fifth object of the invention is to fulfill requirements of different application such as nebulizing two aerosols through acting upon two side liquid supplies by disposing an impingement baffle at the two sides of the driver thereof, respectively.

The sixth object of the invention is to provide a relative action over the entire breadth of the impingement baffle by disposing the liquid delivery device as a plane liquid delivery material The seventh object of the invention is to adjust the application of aerosols produced by modulating the oscillation circuit that further changes the action frequency thereof; the speed of aerosols produced may be varied by the frequency thereof, for example, so that the injection distance and particle diameters of aerosols may be altered accordingly.

The eighth object of the invention is to provide free applications by having the excitation device exposed for oscillating a liquid in a water glass in order to change the molecular structure of the liquid or to come into contact with the skin for direct oscillation that may clean impurities in the skin pores.

The ninth object of the invention is to change the sizes of aerosol particles by replacing the impingement baffle having different sizes of impingement orifices.

BRIEF DESCRIPTION OF THE DRAWINGS

To better understand the technical content of the invention, descriptions shall be given with the accompanying drawings hereunder.

DETAILED DESCRIPTION OF THE PREFERRED EMBODIMENTS

Figure 1:
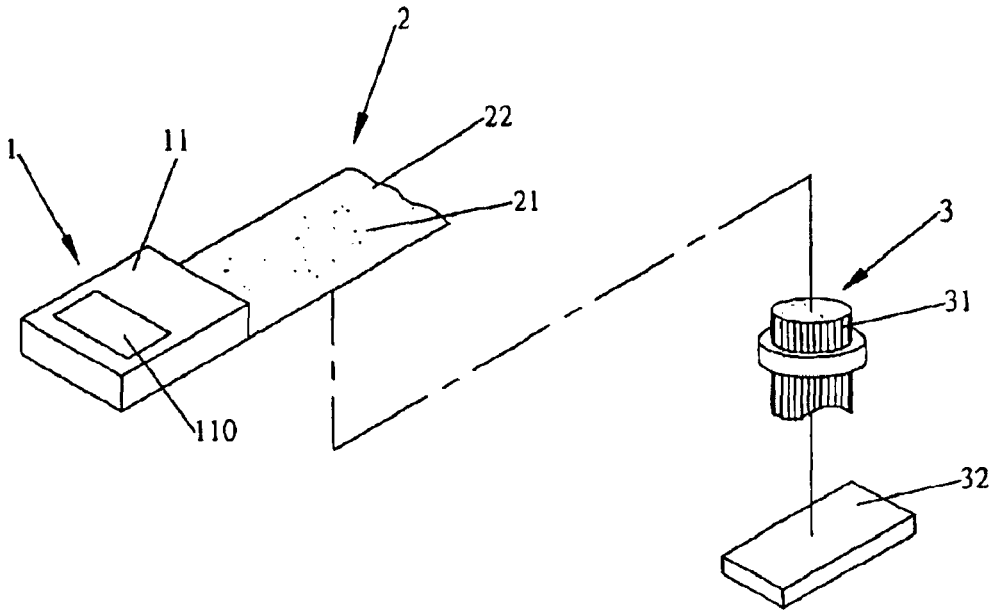
FIG. 1 shows an elevational schematic view of the structure according to the invention.

The nebulizer assembly according to the invention, and more particularly, to a nebuliser assembly that excites liquids into aerosols, comprises an oscillation driver connected with an excitation device, and a liquid delivery device. Referring to FIG. 1, wherein an oscillation driver 1 may adopt any piezoelectric ceramic driven by electricity as an oscillator 11, and at the upper and lower surfaces of the ceramic are provided with a conducting film 110, respectively. At the acting terminal of the oscillation driver 1 is connected with an aerosol excitation device 2 formed by an impingement baffle 22 in the form of a plane disposed with a plurality of micro impingement orifices 21 at the inner breadth thereof. Relatively below the impingement baffle 22 is faced with a liquid delivery device 3. The liquid delivery device 3 is formed by gathering capillary fibers 31 into a bundle distributed with a liquid that further take shape in micro membranes at the upper end thereof. The impingement baffle 22 oscillates at a high frequency after accepting the oscillation energy transmitted by the oscillator 11, and the oscillating direction thereof is perpendicular to the breadth to appear as vibrating up and down. The oscillation of the impingement baffle 22 then acts upon the leveled upper end of the capillary fibers 31 to impinge the liquid outward, and aerosol injections are formed from liquid particles flapping due pressure and oscillation effect.

A liquid delivery board 32 may also be employed in the liquid delivery device 3 for drawing a liquid in micro amounts. Similarly, the surface thereof is faced with the acting plane of the impingement baffle 22 for nebulizing the liquid in micro amounts into aerosols in the upward direction of the impingement baffle 22.

Figure 2:
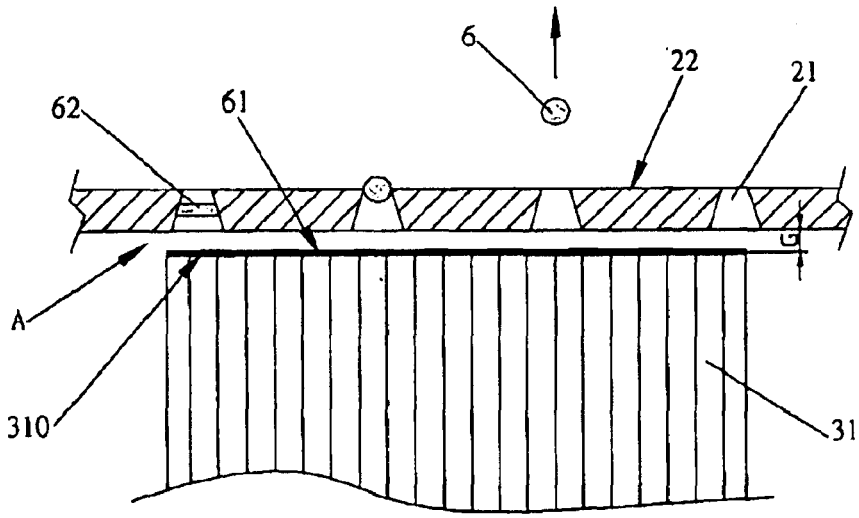
FIG. 2 shows a schematic view according to the invention in operation.

Referring to FIG. 2, the impingement baffle 22 in accordance with the invention is disposed with a plurality of impingement orifices 21. The impingement orifices 21 are connected to the liquid drawn by the capillary fibers 31, and the drawn liquid is then oscillated and compressed through the oscillations such that liquid particles 6 produced inject upward. However, the acting plane of the impingement baffle 22 in accordance with the invention forms a thorough distribution with respect to the liquid drawn by the capillary fibers 31 at the upper end of the capillary fibers 31. Therefore, the liquid thereupon may be regarded as a membrane-like micro distribution. In addition, although the oscillation energy of the impingement baffle 22 stays constant, the liquid oscillated yet becomes micro membranes. As a result, the kinetic energy generated by the impingement baffle 22 is adequate for impinging the micro membranes such that the oscillation energy is used for thoroughly oscillating the micro membranes, thus avoiding other unnecessary loads and energy consumption.

The process of forming aerosol particles 6 from liquid membranes 61 is that, after forming the liquid membranes 61 from the liquid drawn by the liquid delivery fibers 31, the impingement baffle 22 acts by oscillating up and down, and a small gap G for allowing air A to enter exists between the impingement baffle 22 and an upper ends 310 of the liquid delivery fibers 31, so that when the lower ends of the impingement orifices 31 come into contact with the liquid membranes 61, the liquid is adhered upward by the oscillations thereof, thus pressing the impingement baffle 22 downward. In the process of pressing downward, with the aid of the air A, the liquid 62 is compressed and brought outward through the impingement orifices 21. Using this method, the impingement baffle 22 is able to oscillate and compress the distributed liquid membranes 61 formed at the upper ends 310 of the liquid delivery fibers 31 in micro volume units, while also thoroughly acting the energy of the impingement baffle 22 for avoiding loads of other objects (the liquid contained in the reservoir, for instance). Moreover, through the supply of the liquid delivery fibers 31, the liquid is continuously drawn to the upper ends 310 for continuous aerosol impingement.

In the prior art, the whole liquid is loaded; however, in accordance with the invention, the liquid delivery fibers 31 are especially adopted for supplying in micro amounts so that the energy of the impingement baffle 22 is fully used.

The impingement orifices 21 disposed at the impingement baffle 22 may also be cones in shape having comparatively smaller diameters at the output terminals thereof. During the compression process of the liquid 62, because apertures near the output terminals are smaller, and the flowing speed is increased for producing larger kinetic energy to have the aerosol particles inject with longer distances. In accordance with the invention, the injection distance of the aerosols produced may reach 15 cm.

Figure 3:
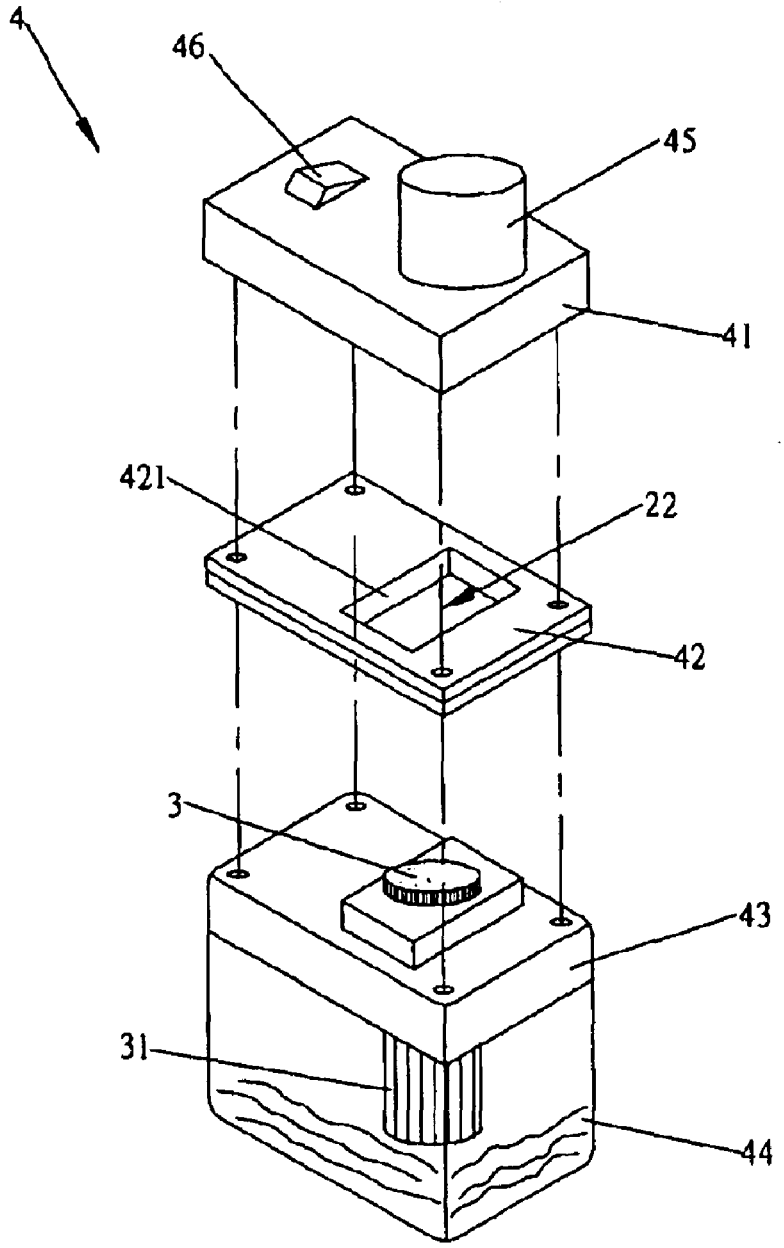
FIG. 3 shows a schematic view according to the invention in application.

The invention may be applied in medical equipment as a practical medical nebulizer 4. Referring to FIG. 3, the nebulizer 4 is provided with a cover 41 connected with an excitation unit 42 at the bottom portion thereof, and the excitation unit 42 is further connected to a reservoir 44 via a delivery unit 43. The reservoir 42 stores not only liquids for common use, but also medicated solutes of medication purposes for producing medicated aerosols used in inhalation therapies, or the medicated aerosol injections are sprayed onto wounds in order to prevent the wounds from being abraded again by applying medication. Above the cover 41 of the nebulizer 4 is disposed with a diversion hood 45 and at one side thereof is provided with a power switch 46 that activates the power therein for an impingement baffle 22 provided in an impingement unit 42 in to further generate kinetic energy. Similarly, the impingement baffle 22 is loaded by an oscillator and is relatively located at the opening 421 provided at the excitation unit 42 so that the aerosols produced are injected upward via the diversion hood 45. In addition, below the excitation unit 42 is connected with the delivery unit 43 and below the impingement baffle 22 is correspondingly provided with the liquid delivery device 3 that draws the liquid from the reservoir 44 through the capillary fibers 31. By using the method and structure, the size of the nebulizer 4 may be reduced to a micro volume portable in one's pocket. Moreover, the delivery unit 43 and the reservoir 44 are readily disassembled so that the liquid stored in the reservoir 44 may be refilled whenever necessary. Also, the density of the capillary fibers 31 disposed in the liquid delivery device 3 may be varied to adjust the amount of aerosols outputted.

Figure 4:
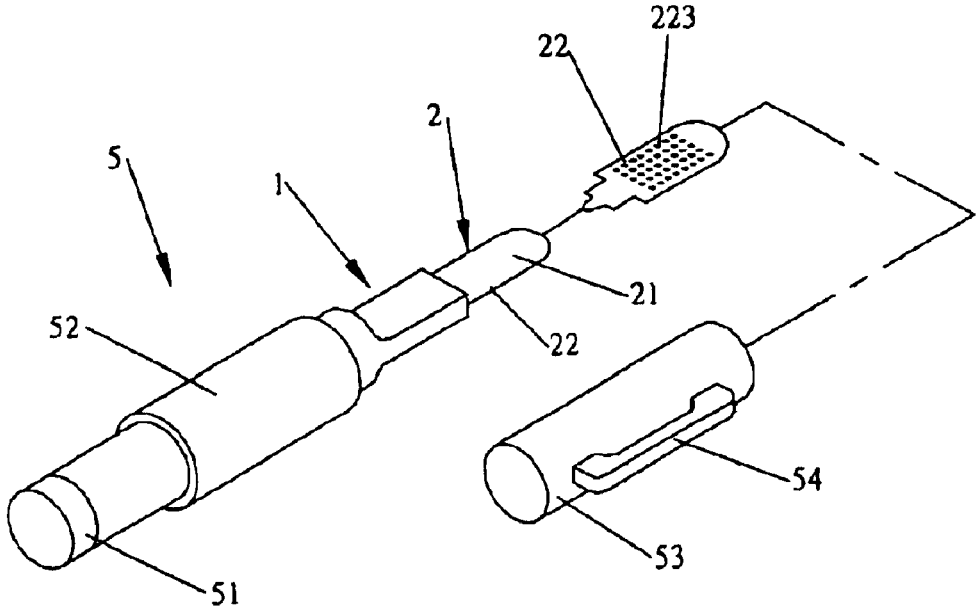
FIG. 4 shows a schematic view according to the invention in another application.

Referring to FIG. 4 showing an embodiment in accordance with the invention that may be used as an oscillator mechanism 5 operating freely. The oscillator 5 in the shape of a pen is provided with a grip 52, and a power switch 51 at one end thereof. A battery oscillation circuit is disposed at the interior of the grip 52 for operations of an oscillator 11. The oscillator 11 is provided with an excitation device 2 at the output end thereof, and the excitation device 2 is similarly consisted of an impingement baffle 22 disposed with impingement orifices 21. For storage, a detachable lid 53 having a clamp 54 is provided. The lid 53 may cover and be fastened to the rear end of the grip 52, thus forming a pen-like shape as well as functioning along with the switch 51. The impingement baffle 22 at the acting terminal may then be operated freely in a water glass 5 or any other containers storing liquids to further oscillate the liquid therein (alcoholic drinks for example) and reduce the pungent taste thereof by changing the molecular structure thereof. The oscillator 11 may also be dipped into the liquid for cooling purposes.

At the interior of the impingement baffle 22 provided in the excitation device 2 may be disposed with impingement orifices 223 having comparatively larger diameters for allowing common impurities to pass through as cleaning for the skin. The compression and oscillation effects of the air may also be similarly used to peel impurities off the skin surface; however, a distinction thereof is that the object of oscillation is targeted at the liquid so that the skin is cleaned by acting upon the impurity particles on the skin surface. In the meanwhile, the oscillation energy thereof is capable of effectively picking up impurities accumulated at the skin pores by excitation; the adhesion between impurities and skin pores is slackened by the oscillation thereof transmitted toward the skin pores to further pass the impurities outward. Apart from the cleaning of impurities, the embodiment in accordance with the invention is also effective for directly removing aged cuticles of the skin. Hence, the oscillation mechanism 5 may also be applied to skin beauty equipment; however, it is then obliged to provide the impingement orifices with larger diameters.

Figure 5:
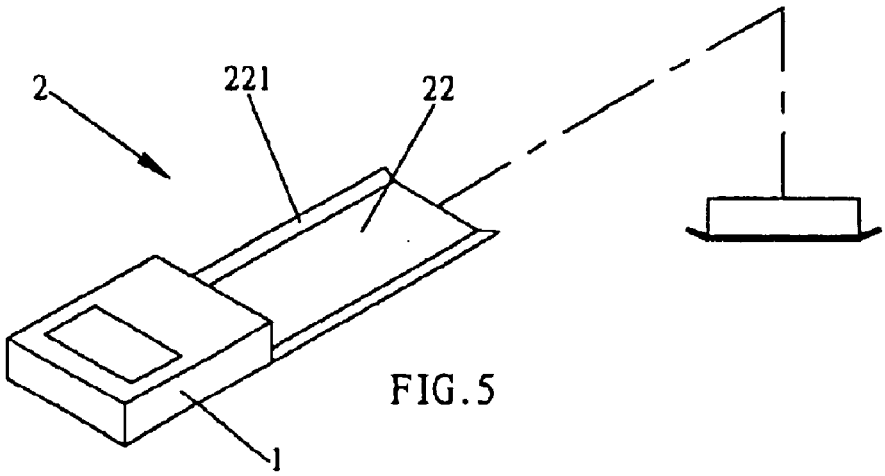
FIG. 5 shows the first embodiment of the nebulizer assembly according to the invention.

Referring to FIG. 5, in order to strengthen the steeliness of the breadth of the impingement baffle 22 provided in the excitation device 2 in accordance with the invention, and to avoid any attenuation of action at the end thereof, at one side of the impingement baffle 22 is provided with a side wing 221 that reinforces the mechanism, such that an uniform strength exists over the breadth as a whole, and thus kinetic energy may also be evenly transmitted over the entire breadth.

Figure 6:
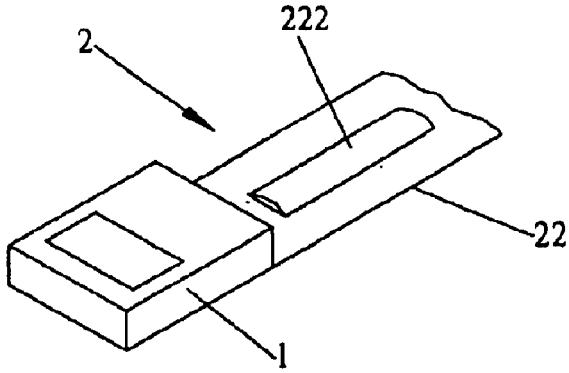
FIG. 6 shows the second embodiment of the nebulizer assembly according to the invention.

Referring to FIG. 6, similarly, in order to fortify the strength of the breadth of the impingement baffle 22, a flange rib 222 may also be provided. The flange rib 222 consolidates the entire breadth in a resembling manner, and kinetic energy is also more effectively transmitted to the ends for even forces of action.

Figure 7:
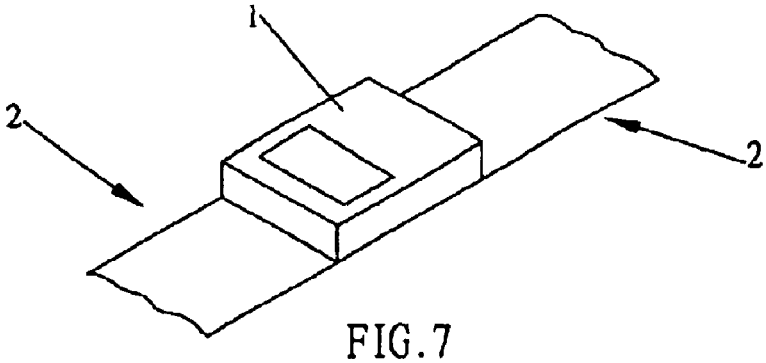
FIG. 7 shows the third embodiment of the nebulizer assembly according to the invention.

Referring to FIG. 7, besides outputting motive force at one end of the driver 1, the excitation device 2 in accordance with the invention may also output energy at the two sides of the driver 1. At the right and left sides of the driver 1 are provided with an excitation device 2, respectively, such that two sprays of aerosols are generated from the invention. The two sprays of aerosols may be adapted for different purposes such as medication, in which two medications with different properties are injected; or for coloring of art design, in which two sprays having different colors may be injected at the same time. However, for applications of art designs, the energy thereof shall be larger than that for other applications, and the power of the driver shall be correspondingly larger as well.

Conclusive from the above, in the nebulizer assembly in accordance with the invention, an excitation device 2 is provided with an impingement baffle 22 further provided a liquid delivery device 3 for supplying liquid of micro amount at the one end thereof. The energy generated by the excitation device 2 is used for aimed excitation with respect to the micro liquid bodies, so that the kinetic energy thereof acts with a maximized performance for a highly efficient nebulization, as well as saving significant energy resources. Also, lower power oscillations are adopted for avoiding high temperatures of the driver. Therefore, the nebulizer assembly in accordance with the invention is a practical design with beneficial operating efficiency and can be applied in various commodities. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A nebulizer assembly for excitation of liquids into aerosols comprising:

a) an oscillation driver;

b) at least one plate-shaped excitation device connected to the oscillation driver and having an impingement baffle having a plurality of impingement orifices formed therein; and c) a liquid delivery device including a plurality of capillary fibers forming micro membranes on an upper end thereof, the liquid delivery device is spaced apart from the at least one plate-shaped excitation device;

wherein the impingement baffle oscillates the micro membranes and impinges the liquids outwardly through the micro membranes, such that kinetic energy of the impingement baffle decomposes, compresses and delivers nebulized liquid particles through the plurality of impingement orifices.

2. The nebulizer assembly according to claim 1, wherein the liquid delivery device includes a liquid delivery board.

3. The nebulizer assembly according to claim 1, wherein the plurality of impingement orifices have a cone shape.

4. The nebulizer assembly according to claim 1, further comprising two reinforcement side wings, each of the two reinforcement side wings is located on one of two opposing sides of the at least one excitation device.

5. The nebulizer assembly according to claim 1, wherein the impingement baffle includes a flange rib located at a breadth thereof.

6. The nebulizer assembly according to claim 1, wherein the at least one excitation device includes two excitation devices located on opposite sides of the oscillation driver.

7. The nebulizer assembly according to claim 1, wherein the plurality of impingement orifices nave diameters to allow impurities to pass there through.

* * * * *